US011445815B2

(12) United States Patent
Kadosh et al.

(10) Patent No.: US 11,445,815 B2
(45) Date of Patent: Sep. 20, 2022

(54) DESKTOP SHIELD SYSTEM

(71) Applicant: Mogogo Ltd, Emek Hefer (IL)

(72) Inventors: Yariv Kadosh, Tel Aviv (IL); Mordehay Ben Aharon, Tel Aviv (IL)

( * ) Notice: Subject to any disclaimer, the term of this patent is extended or adjusted under 35 U.S.C. 154(b) by 0 days.

(21) Appl. No.: 16/907,330

(22) Filed: Jun. 22, 2020

(65) Prior Publication Data

US 2021/0401163 A1 Dec. 30, 2021

(51) Int. Cl.
*A47B 13/00* (2006.01)
*A47B 97/00* (2006.01)

(52) U.S. Cl.
CPC ..... *A47B 13/00* (2013.01); *A47B 97/00* (2013.01); *A47B 2200/0084* (2013.01)

(58) Field of Classification Search
CPC . A47B 97/00; A47B 13/00; A47B 2200/0084; A47F 2010/065
See application file for complete search history.

(56) References Cited

U.S. PATENT DOCUMENTS 4,156,449 A * 5/1979 Petersen ..... A47F 10/06 160/290.1
4,892,366 A * 1/1990 Yerman ..... A47F 3/007 312/140.4
6,132,018 A * 10/2000 McGrath ..... A47F 3/007 248/398
D613,971 S * 4/2010 Matus, Jr. ..... D6/699.4
8,136,460 B2 * 3/2012 Tait ..... E04H 3/24 108/157.1
9,557,004 B1 * 1/2017 McGrath ..... F16M 13/02
10,881,222 B1 * 1/2021 Keane London ..... A47B 97/00
2005/0061585 A1 * 3/2005 Yingst ..... A47F 3/007 186/38
2007/0090733 A1 * 4/2007 Matus, Jr. ..... A47F 10/06 312/140.4
2009/0095204 A1 * 4/2009 Levy ..... A47B 7/02 108/17
2019/0313788 A1 * 10/2019 Sheldon ..... F16B 1/00
2020/0245786 A1 * 8/2020 Kurmlavage ..... A47F 10/06

* cited by examiner

*Primary Examiner* — Matthew W Ing

(57) ABSTRACT

A desktop shield system for splashes protection that has a right rod, a left rod and a panel shield. The lower end of the right rod is connected to a base that its first side has a protrusion that corresponds with a recess at its second side. The right rod also includes magnet elements that are connected to its right side at a zero height. The left rod is designed in the same way as the right one but in reverse as a mirror view. The system can be connected with a another identical system, in a way that the recess of the left rod of the another system is assembled with the protrusion of the right rod of the system and the magnet elements of the left rod of the another system magnetically connected with the magnet elements of the right rod of the system.

2 Claims, 7 Drawing Sheets

DESKTOP SHIELD SYSTEM

TECHNICAL FIELD

The present invention refers to a desktop shield system for splashes and sprays protection.

BACKGROUND ART

There is a need for a modular desktop shield system for splashes and sprays protection in the sense that two or more identical units can be used, attached and combined together to form a desired length and angle. The present invention discloses an effective solution for these needs and others.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

The main object of the present invention is to provide a desktop shield system (1) for splashes and sprays protection of personnel, such as check-in and receptionist staff, when they provide service to the public. The desktop shield system is modular, in the sense that two or more identical units of the system can be used, attached and combined together to form the desired length and angle. The bottom edge of the panel can be adjacent to the desk or slightly higher than the desk height to create an opening for exchange of materials. The system can be assembled very easily; it can be easily placed on any flat table without the need for table connections. As will be explained below, a shield front can be created by using several units of the system both in a straight line and at a variety of angles, without having open spaces between one system to the adjacent one.

Figure 1:
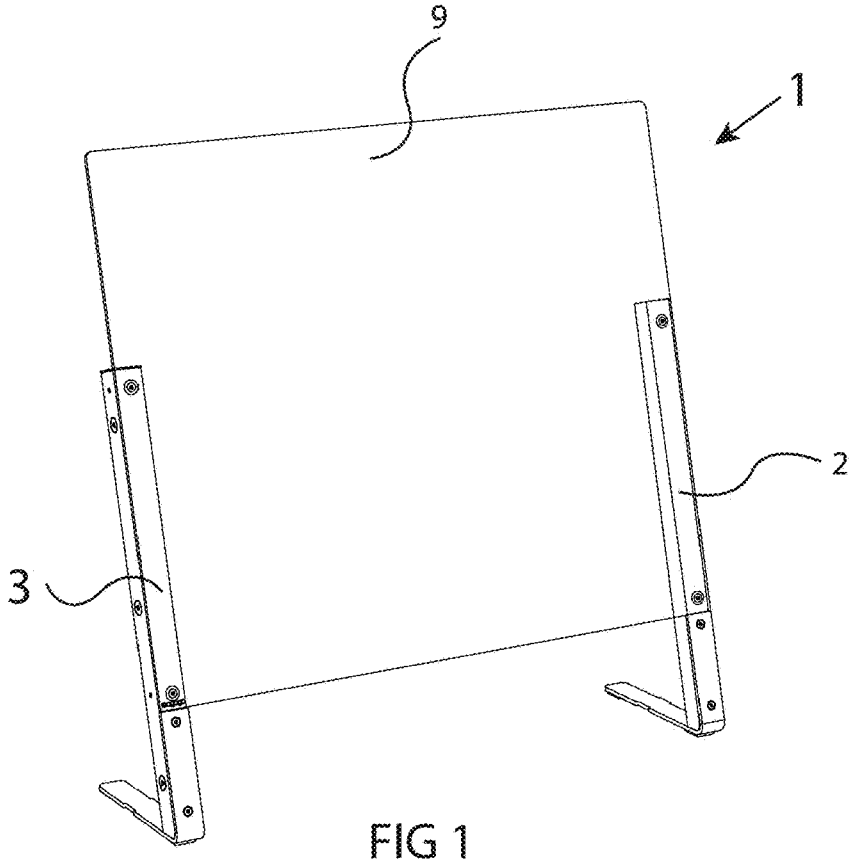
FIGS. 1 and 2 depict the system (1).
Figure 2:
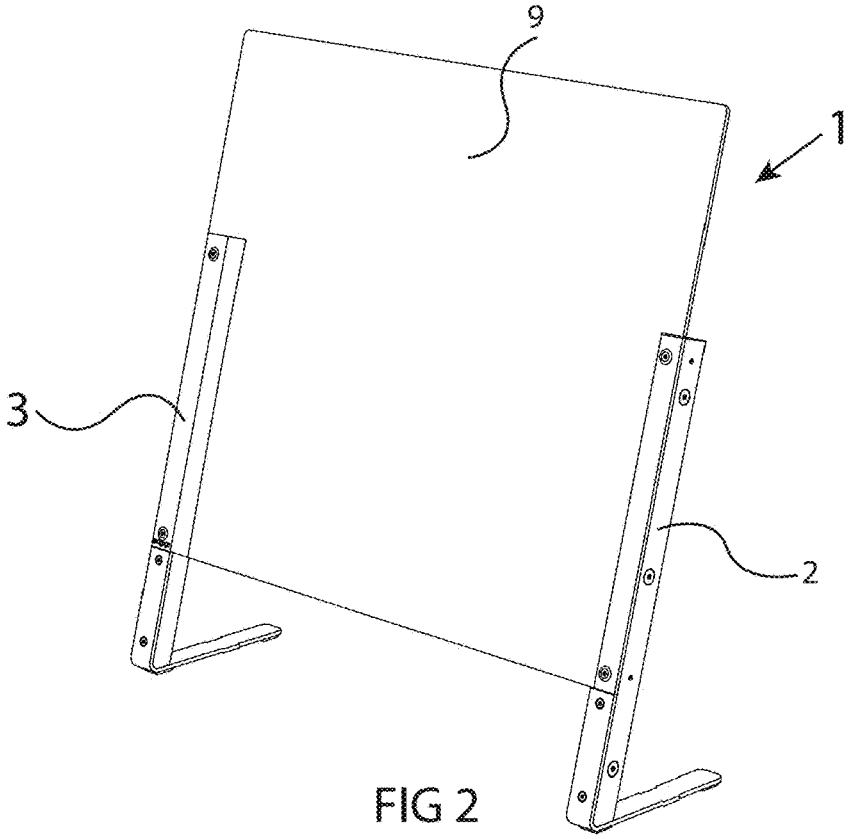
Figure 3A:
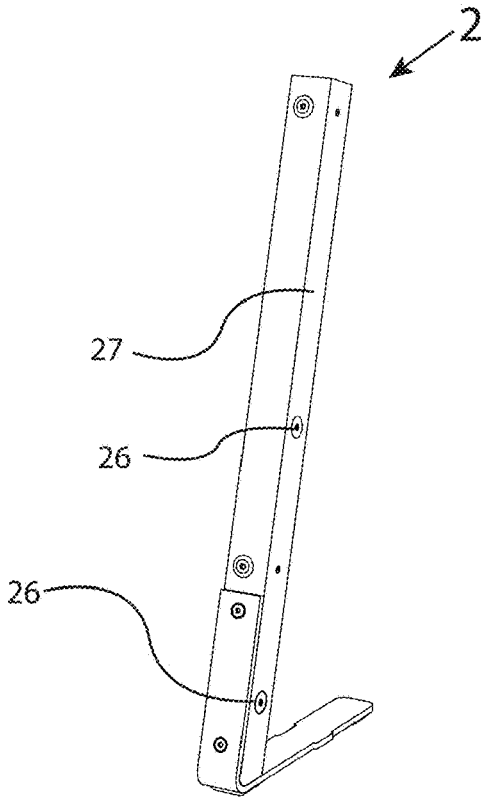
FIGS. 3A and 3B depict the right supporting rod (2).
Figure 3B:
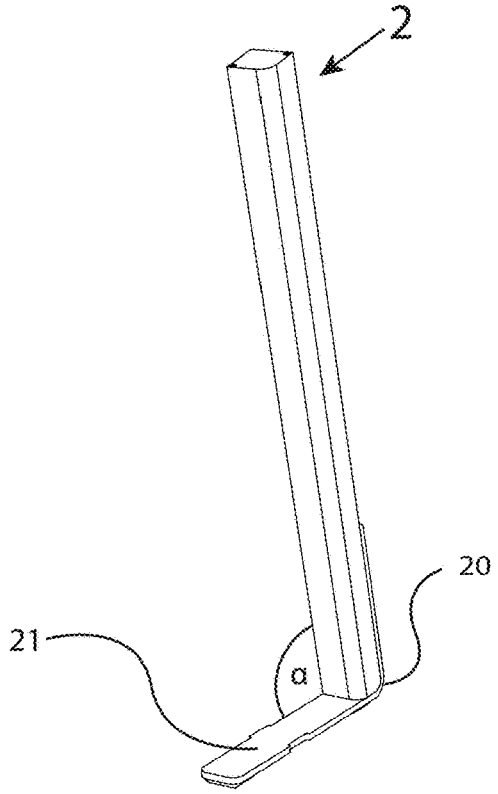
Figure 4A:
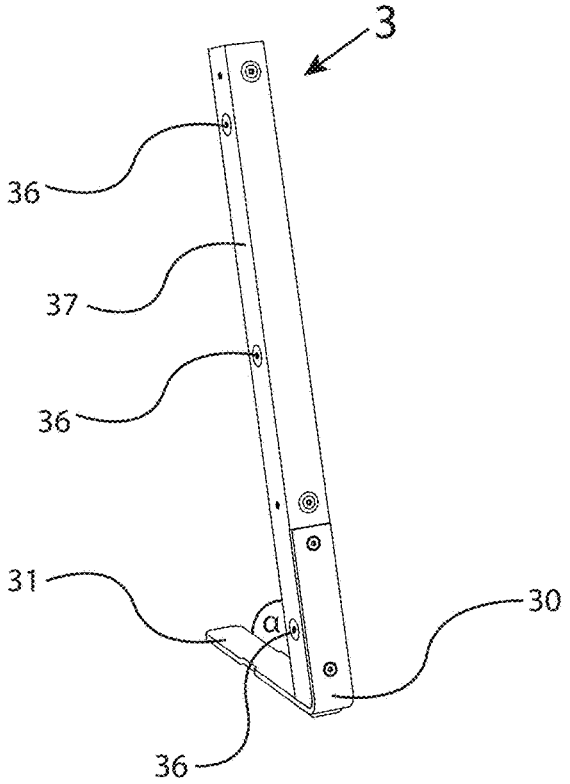
FIGS. 4A and 4B depict the left supporting rod (3).
Figure 4B:
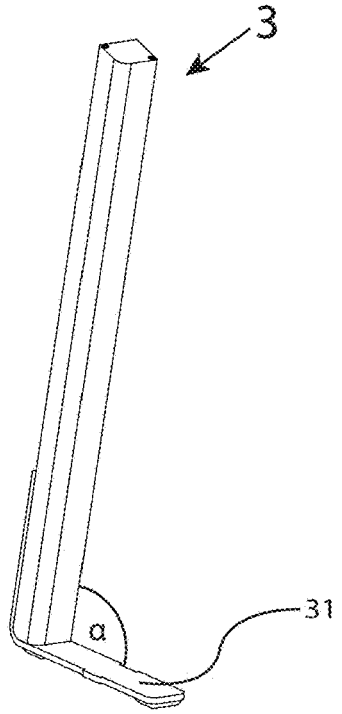
Figure 5A:
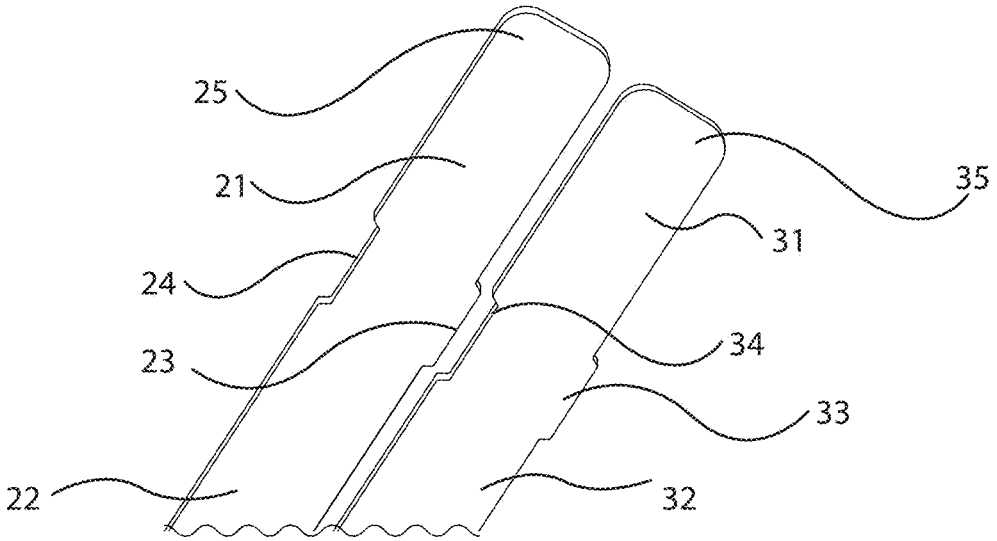
FIGS. 5A and 5B depict the recesses and the protrusions of the base.
Figure 5B:
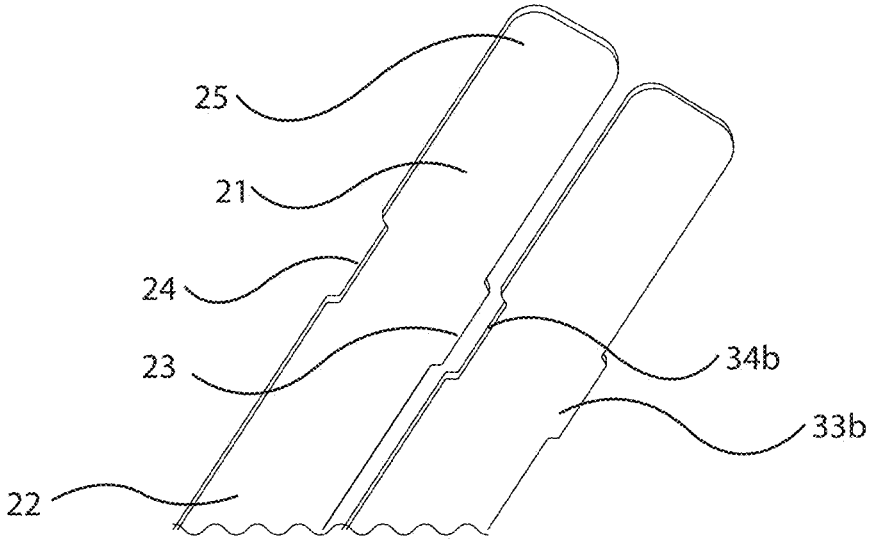
Figure 6B:
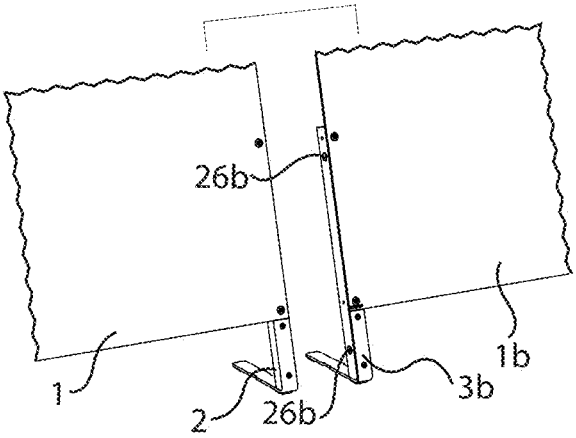
FIGS. 6 and 7 depict the system (1) and the second system (1*b*).
Figure 6A:
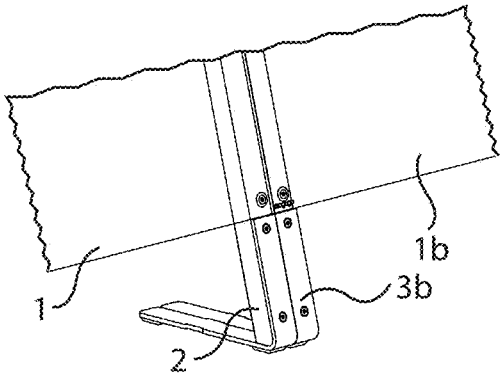

The desktop shield system (1) includes a right supporting rod (2), a left supporting rod (3) and a panel (9) that is designed to be connected to the right and the left supporting rods. The terms "right" and "left" come to express the side of each leg from the client's point of view facing the employee sitting at the desk and are intended to make it easier to describe the system. The panel can be a plastic or a glass for example. FIGS. 1 and 2 depict the system (1), FIGS. 3A and 3B depicts the right supporting rod (2) and FIGS. 4A and 4B depicts the left supporting rod (3).

The desktop shield system (1) includes the right supporting rod (2) that its lower end (20) is connected to a first horizontal base (21) at a specific angle (a) that is less than ninety degrees. The first side (22) of the first horizontal base has a protrusion (23) that corresponds with a recess (24) at a second side (25) of the first horizontal base. The right supporting rod includes at least one magnet element (26) that is connected to the right side (27) of the right supporting rod at a zero height.

The desktop shield system (1) includes also the left supporting rod (3) that its lower end (30) is connected to a second horizontal base (31) at the same specific angle (a). The first side (32) of the second horizontal base has a protrusion (33) that corresponds with a recess (34) at a second side (35) of the second horizontal base. The left supporting rod is also includes at least one magnet element (36) that is connected to a left side (37) of the left supporting rod at a zero height.

The recesses and the protrusions should be in opposite at each horizontal base so that when coupling one base to another base then the protrusion of the first base fits into the recess of the adjacent base as depicted in FIGS. 5A, 5B, 6A and 6B.

Figure 7:
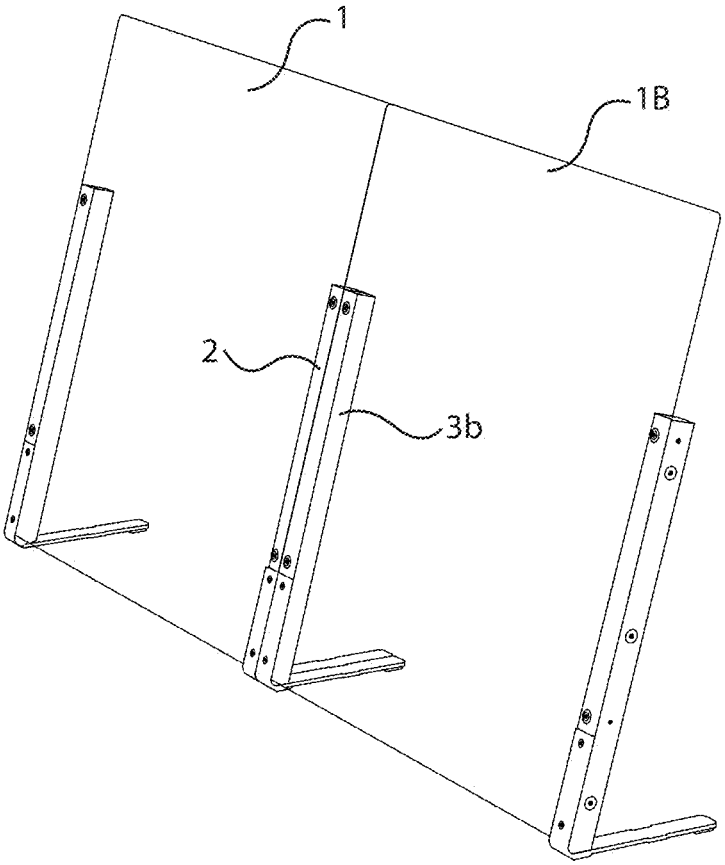
Figure 8:
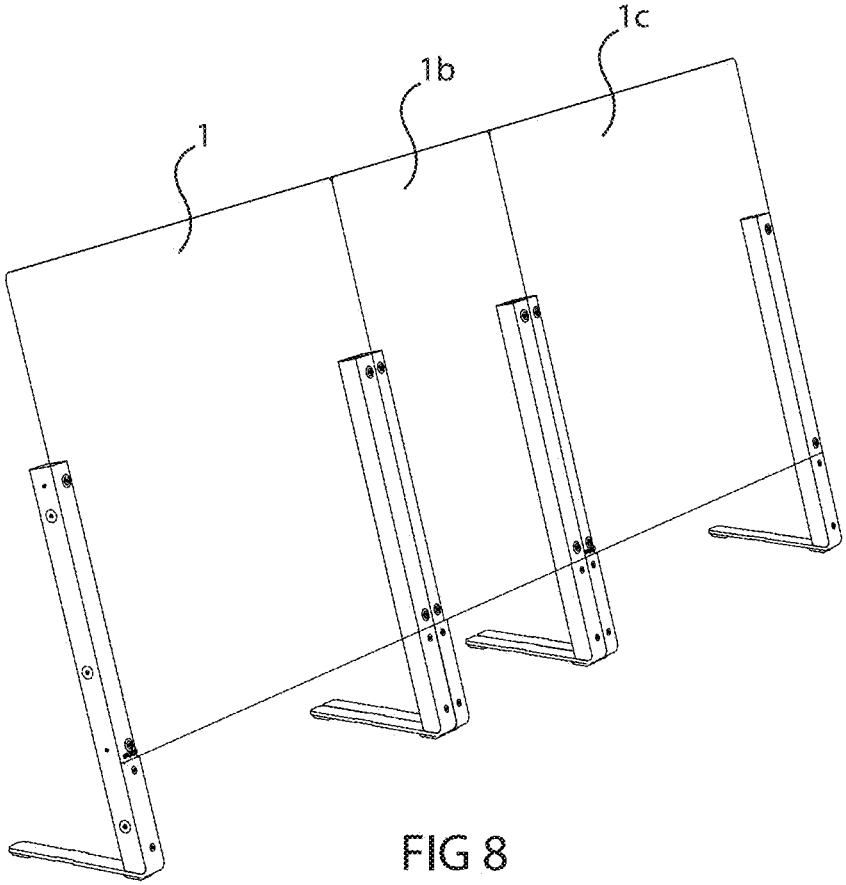
FIG. 8 depicts the system (1), the second system (1*b*) and a third system (1*c*).

The desktop shield system (1) is designed to be connected with a second desktop shield system (1*b*), in a way that the recess (33*b*) of the left supporting rod (3*b*) of the second system (1*b*) is assembled with the protrusion (23) of the right supporting rod (2) of the system (1) and that at least one magnet element (26*b*) of the left supporting rod of the second system is magnetically connected with the at least one magnet element (26) of the right supporting rod of the system (1), as illustrated for example in FIG. 7 that depicts the system (1) and the second system (1*b*) and in FIG. 8 that depicts the system (1), the second system (1*b*) and a third system (1*c*).

The term "magnet element" means a magnet or a metal magnet so that it is possible for example to put magnets in the left legs and metal magnets in the right legs, or vice versa. So, when the left leg of one system is coupled to the right leg of an adjacent system, the magnet and the metal magnet cling together causing the two systems to stick together and at the same time, the protrusion and recess of the bases that are combined together prevent relative movement in terms of the width axis and the connection of the systems together is stable.

The relatively sharp angle between the bases and the legs causes the panel to tilt slightly back to allow the client to stand close to the table without having his nose very close to the panel.

Figure 9:
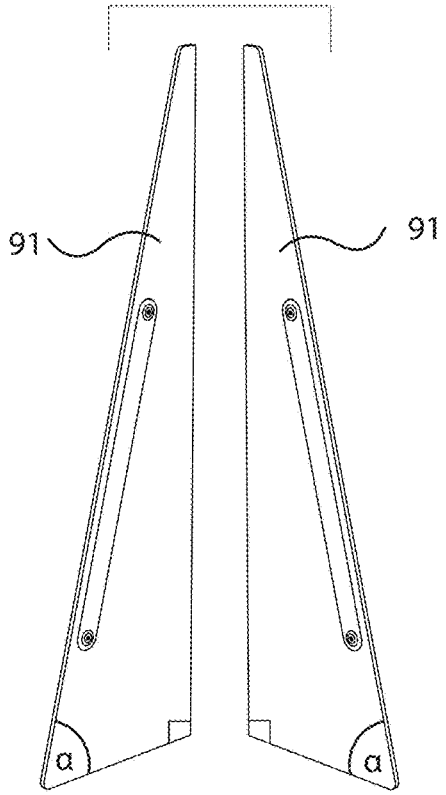
FIG. 9 depicts the triangular corner panel (91).

The desktop shield system (1) may further include a triangular corner panel (91) that its front base angle (a) is at a same size as the specific angle ($\alpha$) and its back base angle (b) is a right angle. It is preferably that the dimension of the triangular corner panel will be substantially as the same size of the imaginary triangle formed between the supportive rod and its base when an imaginary vertical line is lowered from the top of the rod. The triangular corner panel (91) is depicted in FIG. 9 and is designed to be connected to a right side or a left side of the desktop shield system as depicted for example in FIGS. 10-12.

Figure 10:
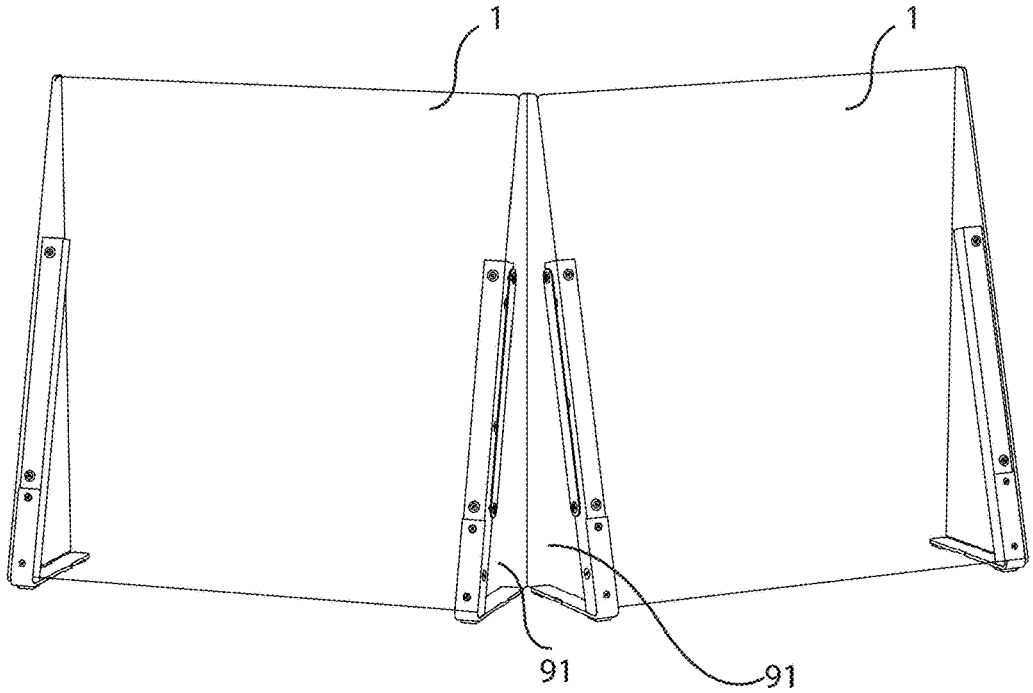
FIGS. 10-12 depict the systems with triangular corner panels.
Figure 11:
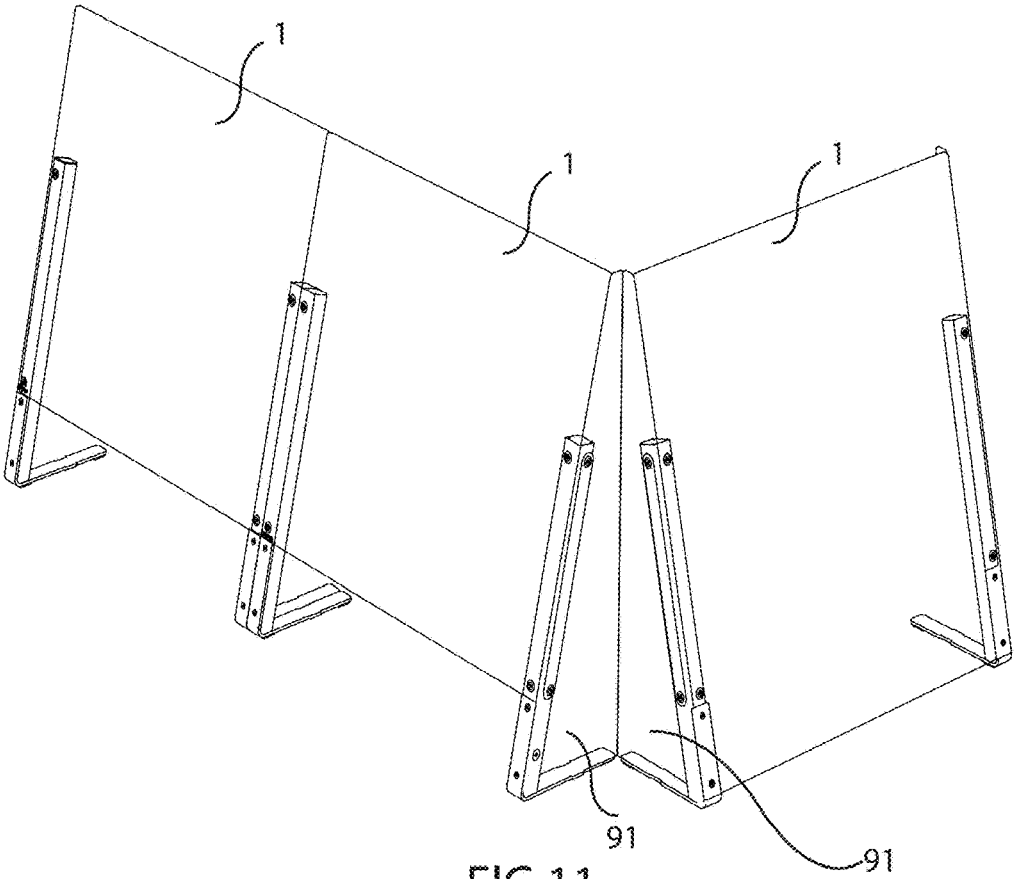
Figure 12:
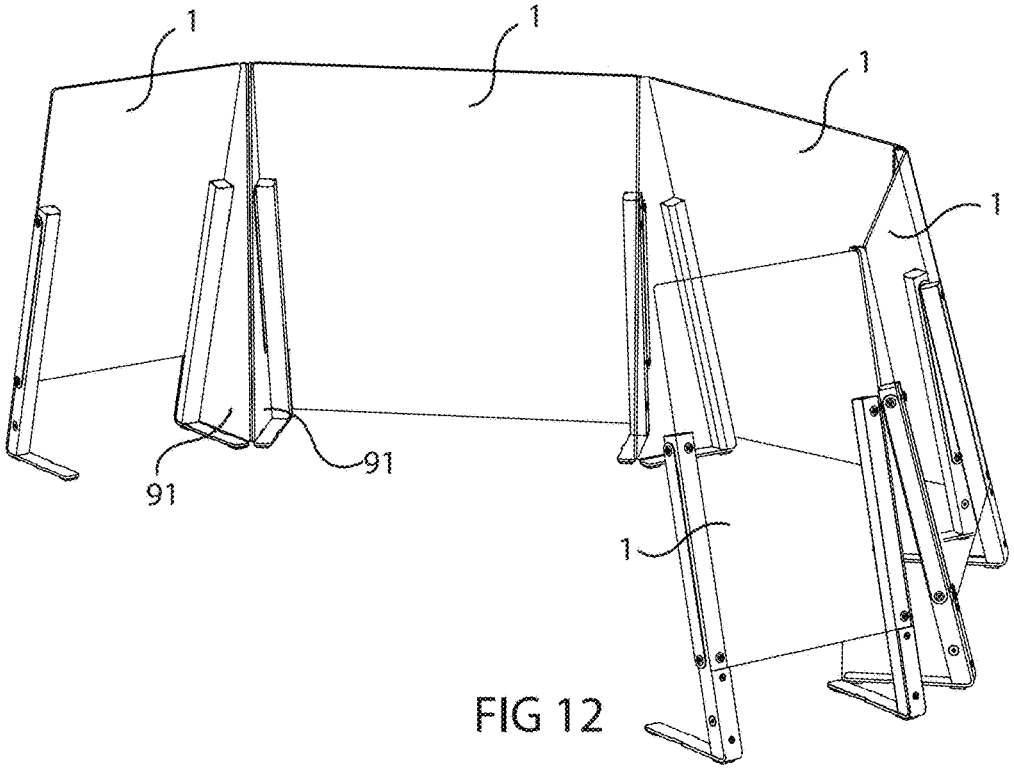

Due to the fact that the rear side of the triangular panel is straight, it is possible to place two systems, each of which has a triangular corner panel adjacent to each other in any relative angle without having a space between these systems, since the rear sides of the triangular panel fully falls one to the other, as depicted for example in FIGS. 10 to 12. The panel (9) and the triangular panel (91) are designed to be connected to the rods (2) and (3) by screws or by any other known attachments means.

What is claimed is:

1. A desktop shield system for splashes and sprays protection, comprising:

a right supporting rod that a lower end of the right supporting rod is connected to a first horizontal base at a specific angle that is less than ninety degrees; wherein a first side of the first horizontal base has a protrusion that corresponds with a recess at a second side of the first horizontal base; wherein said right supporting rod includes at least one magnet element that is connected to a right side of said right supporting rod;

a left supporting rod that a lower end of the left supporting rod is connected to a second horizontal base at the specific angle; wherein a first side of the second horizontal base has a protrusion that corresponds with a recess at a second side of the second horizontal base; wherein said left supporting rod includes at least one magnet element that is connected to a left side of said left supporting rod;

a panel shield that is designed to be connected to the right supporting rod and to the left supporting rod;

wherein the desktop shield system is designed to be connected with a second desktop shield system, in a way that a recess of a left supporting rod of the second desktop shield system can be assembled with the protrusion of the right supporting rod of the desktop shield system and that at least one magnet element of the left supporting rod of the second desktop shield system can be magnetically connected with the at least one magnet element of the right supporting rod of the desktop shield system.

2. The desktop shield system for splashes and sprays protection according to claim 1 that further includes a triangular corner panel; wherein a front base angle of the triangular corner panel is at a same size of said specific angle and a back base angle of the triangular corner panel is a right angle; wherein said triangular corner panel is designed to be connected to a right side or a left side of the desktop shield system.

* * * * *